US008490438B2

(12) United States Patent
Kim et al.

(10) Patent No.: US 8,490,438 B2
(45) Date of Patent: Jul. 23, 2013

(54) LAUNDRY TREATMENT DEVICE

(75) Inventors: Na Eun Kim, Seoul (KR); Cheol Soo Ko, Seoul (KR); Dong Soo Lee, Seoul (KR); Young Min Kim, Seoul (KR); Hea Kyung Yoo, Seoul (KR); Sung Ryong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 568 days.

(21) Appl. No.: 12/700,176

(22) Filed: Feb. 4, 2010

(65) Prior Publication Data

US 2010/0192639 A1 Aug. 5, 2010

(30) Foreign Application Priority Data

Feb. 5, 2009 (KR) ..... 10-2009-0009375
Feb. 12, 2009 (KR) ..... 10-2009-0011335

(51) Int. Cl.

| | |
|---|---|
| ***D06F 25/00*** | (2006.01) |
| ***D06F 29/00*** | (2006.01) |
| ***D06F 58/18*** | (2006.01) |
| ***D06F 58/24*** | (2006.01) |
| ***D06F 58/28*** | (2006.01) |

(52) U.S. Cl.
USPC ..... 68/3 R; 68/20; 34/76; 34/596

(58) Field of Classification Search
USPC ..... 68/3 R, 19.1, 20; 34/76, 77, 596, 34/604, 607
See application file for complete search history.

(56) References Cited

U.S. PATENT DOCUMENTS

| | | | | |
|---|---|---|---|---|
| 2,334,025 | A * | 11/1943 | O'Neill | 34/85 |
| 2,351,429 | A * | 6/1944 | Huebsch | 34/127 |
| 2,566,488 | A * | 9/1951 | Gould | 68/20 |
| 2,677,897 | A * | 5/1954 | Herbster | 34/90 |
| 2,755,072 | A | 7/1956 | Kreuttner | |
| 2,830,385 | A * | 4/1958 | Smith | 34/601 |
| 2,943,473 | A | 7/1960 | Worst | |
| 3,064,358 | A * | 11/1962 | Giuffre | 34/569 |
| 3,636,735 | A | 1/1972 | Borochaner | |
| 4,292,744 | A | 10/1981 | Nabholz | |
| 4,603,489 | A | 8/1986 | Goldberg | |
| 4,621,438 | A | 11/1986 | Lanciaux | |
| 5,174,467 | A | 12/1992 | Sullivan | |
| 5,343,632 | A | 9/1994 | Dinh | |
| 5,392,613 | A | 2/1995 | Bolton et al. | |
| 5,640,783 | A * | 6/1997 | Schumaier | 34/219 |

(Continued)

FOREIGN PATENT DOCUMENTS

| | | |
|---|---|---|
| CN | 1542208 A | 11/2004 |
| CN | 2680709 | 2/2005 |

(Continued)

OTHER PUBLICATIONS

International Search Report and Written Opinion dated Oct. 11, 2010 (Application No. PCT /KR2010/001317).

(Continued)

*Primary Examiner* — Joseph L Perrin
(74) *Attorney, Agent, or Firm* — KED & Associates LLP

(57) ABSTRACT

A laundry treatment device is provided which includes a first space for laundry treatment, a second space formed separate from the first space, and an air supply device provided in the second space, the air supply device supplying heated dry air to the first space.

13 Claims, 11 Drawing Sheets

U.S. PATENT DOCUMENTS

| | | | | |
|---|---|---|---|---|
| 5,664,430 | A | 9/1997 | Karman | |
| 5,689,962 | A | 11/1997 | Rafalovich | |
| 5,697,227 | A | 12/1997 | Bruce et al. | |
| 5,732,562 | A | 3/1998 | Moratalla | |
| 5,732,565 | A | 3/1998 | Ramakrishnan et al. | |
| 5,787,721 | A | 8/1998 | Fromm et al. | |
| 5,806,207 | A | 9/1998 | Merrigan | 34/603 |
| 5,901,566 | A | 5/1999 | Macosko et al. | |
| 6,085,539 | A | 7/2000 | Meyer | |
| 6,098,310 | A | 8/2000 | Chen et al. | 34/475 |
| 6,471,739 | B2 | 10/2002 | Eom | |
| 6,701,739 | B2 | 3/2004 | Morse | |
| 7,055,262 | B2 * | 6/2006 | Goldberg et al. | 34/86 |
| 7,165,416 | B2 | 1/2007 | Lee et al. | |
| 7,168,274 | B2 * | 1/2007 | Slutsky et al. | 68/19 |
| 7,174,741 | B2 | 2/2007 | Lee et al. | |
| 7,213,407 | B2 | 5/2007 | Hu | |
| 7,263,852 | B2 | 9/2007 | Bacchus | |
| 7,284,388 | B2 | 10/2007 | Yoshida | |
| 7,325,333 | B2 | 2/2008 | Tadano et al. | |
| 7,409,776 | B2 | 8/2008 | Ono et al. | |
| 7,418,826 | B2 | 9/2008 | Rios et al. | |
| 7,430,877 | B2 | 10/2008 | Davenport et al. | |
| 7,469,486 | B2 | 12/2008 | Tamura et al. | |
| 7,694,434 | B2 * | 4/2010 | Lee | 34/607 |
| 7,866,061 | B2 | 1/2011 | Tatsumi et al. | |
| 7,908,766 | B2 | 3/2011 | Ahn et al. | |
| 7,950,245 | B2 | 5/2011 | Lee et al. | |
| 7,975,502 | B2 | 7/2011 | Tamura et al. | |
| 7,984,568 | B2 * | 7/2011 | Dittmer et al. | 34/595 |
| 8,037,707 | B2 | 10/2011 | Lee et al. | |
| 8,056,351 | B2 | 11/2011 | Marciano et al. | |
| 8,079,157 | B2 | 12/2011 | Balerdi Azpilicueta et al. | |
| 8,171,748 | B2 | 5/2012 | Ooishi et al. | |
| 2004/0079121 | A1 | 4/2004 | Yabuuchi et al. | 68/19.2 |
| 2004/0182100 | A1 | 9/2004 | Lee et al. | |
| 2005/0198851 | A1 | 9/2005 | Tomochika et al. | |
| 2005/0204755 | A1 | 9/2005 | Nishiwaki et al. | |
| 2006/0191289 | A1 | 8/2006 | Bush et al. | |
| 2006/0218976 | A1 | 10/2006 | Lee et al. | 68/15 |
| 2006/0263501 | A1 | 11/2006 | Oghafua et al. | |
| 2007/0095111 | A1 | 5/2007 | Watkins et al. | |
| 2007/0113574 | A1 | 5/2007 | Davenport et al. | |
| 2007/0134522 | A1 | 6/2007 | Ko et al. | |
| 2008/0000253 | A1 | 1/2008 | Kim et al. | |
| 2008/0223084 | A1 | 9/2008 | Kuwabara | |
| 2009/0013730 | A1 | 1/2009 | Woo et al. | |
| 2010/0077787 | A1 | 4/2010 | Masuda et al. | |
| 2010/0107703 | A1 | 5/2010 | Hisano et al. | |
| 2010/0180621 | A1 | 7/2010 | Lee et al. | |
| 2010/0326116 | A1 | 12/2010 | Kwon | |

FOREIGN PATENT DOCUMENTS

| | | | | |
|---|---|---|---|---|
| CN | 1667177 | | | 9/2005 |
| CN | 1695029 | | | 11/2005 |
| CN | 1966844 | | | 5/2007 |
| CN | 101122405 | | | 2/2008 |
| CN | 101122410 | | | 2/2008 |
| CN | 101135101 | | | 3/2008 |
| CN | 101139791 | | | 3/2008 |
| CN | 101153456 | | | 4/2008 |
| CN | 101173478 | | * | 5/2008 |
| CN | 101187140 | | | 5/2008 |
| CN | 101348989 | | | 1/2009 |
| DE | 42 12 700 | A1 | | 10/1993 |
| EP | 0 943 721 | A1 | | 9/1999 |
| EP | 1 634 984 | A1 | | 3/2006 |
| EP | 1 726 703 | | | 11/2006 |
| GB | 2 289 752 | A | | 11/1995 |
| JP | 59-085694 | | * | 5/1984 |
| JP | 2001-212599 | | | 8/1989 |
| JP | 02-029296 | | * | 1/1990 |
| JP | 05-049795 | | * | 3/1993 |
| JP | 2001-198398 | | * | 7/2001 |
| JP | 2006-110394 | | | 4/2006 |
| JP | 2006-345919 | | | 12/2006 |
| JP | 2007-127326 | | * | 5/2007 |
| JP | 2007-175528 | | | 7/2007 |
| JP | 2007-330439 | A | | 12/2007 |
| JP | 2007-330571 | | | 12/2007 |
| JP | 2008-000226 | A | | 1/2008 |
| JP | 2008-006127 | | | 1/2008 |
| JP | 2008-48830 | | | 3/2008 |
| KR | 10-2006-0052284 | | | 5/2006 |
| KR | 10-2007-0082377 | | | 8/2007 |
| KR | 10-2008-0056007 | | | 6/2008 |
| WO | WO 2005/090669 | | | 9/2005 |
| WO | WO 2006/009364 | | | 1/2006 |
| WO | WO 2006/097901 | A2 | | 9/2006 |

OTHER PUBLICATIONS

International Search Report and Written Opinion dated Oct. 19, 2010 (Application No. PCT/KR2010/000713).
International Search Report and Written Opinion dated Apr. 13, 2010 issued in Application No. PCT/KR2010/000487.
International Search Report and Written Opinion dated Aug. 2, 2010 issued in Application No. PCT/KR2010/000867.
U.S. Office Action issued in U.S. Appl. No. 12/700,190 dated Jun. 29, 2012.
Chinese Office Action dated Aug. 13, 2012 (5041.X) with translation.
Chinese Office Action dated Aug. 13, 2012 (4986.X) with translation.
Chinese Office Action dated Aug. 14, 2012 (5040.5) with translation.
Chinese Office Action dated Aug. 28, 2012 (5042.4) with translation.
U.S. Office Action issued in U.S. Appl. No. 12/709,816 dated Oct. 22, 2012.
European Search Report dated Nov. 16, 2012 issued in Application No. 10 73 8756.
Chinese Office Action dated Nov. 26, 2012 issued in Application No. 201080005766.9 (with English translation).
U.S. Office Action issued in U.S. Appl. No. 12/709,751 dated Apr. 5, 2013.
Machine translation of JP 2006-345919, Dec. 28, 2006.

* cited by examiner

LAUNDRY TREATMENT DEVICE

This application claims the benefit of the Korean Patent Application No. 10-2009-0011335, filed in Korea on Feb. 12, 2009, and Korean Patent Application No. 10-2009-0009375, filed in Korea on Feb. 5, 2009, which are both hereby incorporated by reference as if fully set forth herein.

BACKGROUND

1. Field

A laundry treatment device is disclosed herein.

2. Background

Laundry treatment devices are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. Wherever possible, like reference numbers have been used throughout the drawings to refer to the same or like parts.

Laundry machines or laundry treatment devices may be categorized as washers that perform only washing, washing machines having a drying function, and dryers that perform only drying. Further, laundry machines or laundry treatment devices may be categorized into top loading types and front loading types. In the top loading type, washing objects, for example, clothes, cloth items, and beddings (hereinafter referred to as "laundry") may be loaded through a top of the laundry treatment device. In the front loading type, laundry may be loaded through a front of the laundry treatment device.

However, washing machines having a drying function includes a dryer that supplies dried air therein. As a result, the configuration is complex and they are not easy to perform maintenance work on.

Figure 1:
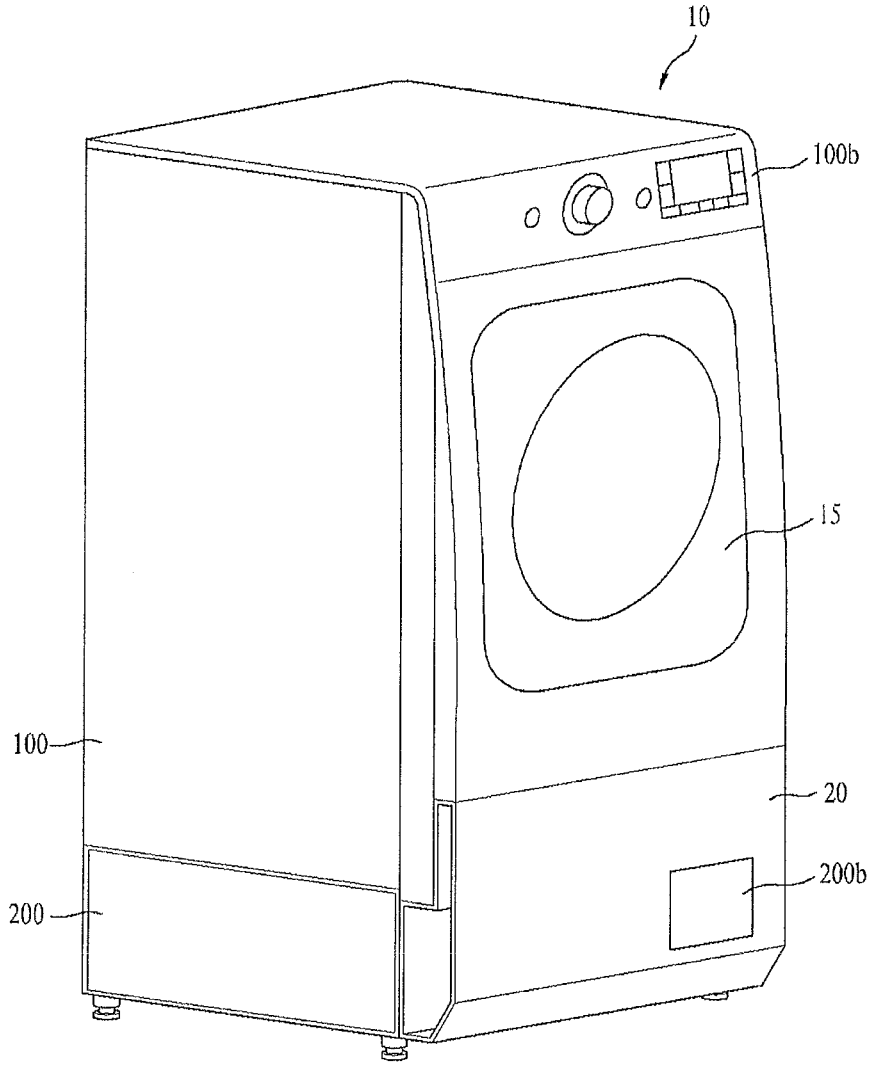
FIG. 1 is front perspective view of a laundry treatment device according to an embodiment.
Figure 2:
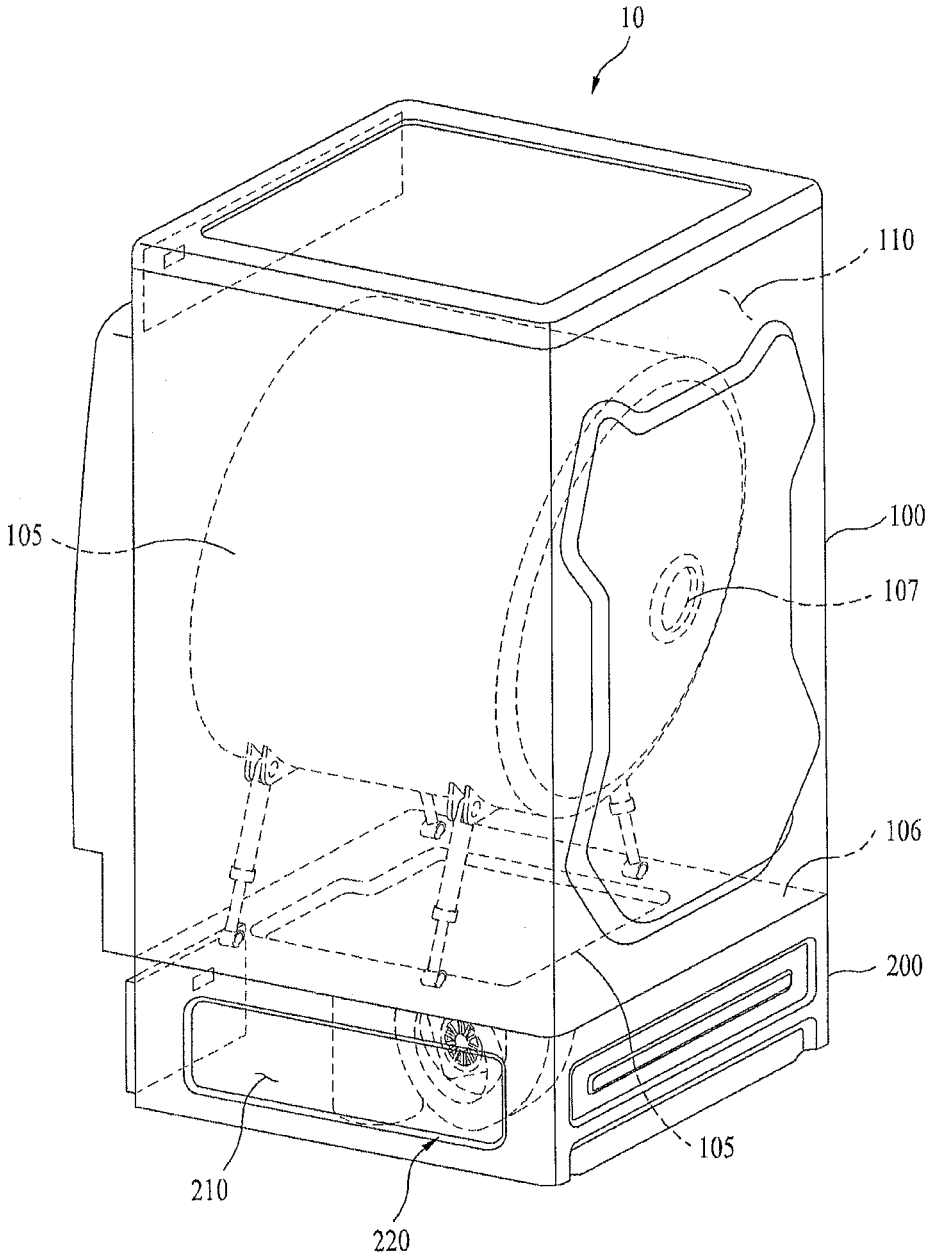
FIG. 2 is a rear perspective view of the laundry treatment device of FIG. 1.

FIG. 1 is front perspective view of a laundry treatment device according to an embodiment. FIG. 2 is a rear perspective view of the laundry treatment device of FIG. 1. Referring to FIGS. 1 and 2, a laundry treatment device 10 according to this embodiment may include a first cabinet 100 and a second cabinet 200. The first and second cabinets 100 and 200 may define an exterior appearance of the laundry treatment device 10 and may include various elements which will be described hereinafter.

The first and second cabinets 100 and 200 may be formed as separate cabinets, which may then be joined together. Providing the first and second cabinets 100 and 200 as separate cabinets, which may then be joined together, allows the first cabinet 100, which is configured for laundry treatment, and the second cabinet 200, which may include a heated-dry-air supply device, to be manufactured separately and assembled at the manufacturing plant or at a later point. For example, the first and second cabinets 100 and 200 may be manufactured or assembled separately and then shipped to another destination for assembly. Further, a user or customer may not desire a laundry treatment device including the second cabinet and/or the heated-dry-air supply device, and thus, may elect to purchase only the first cabinet 100, which is configured for laundry treatment. Further, if the first and second cabinets 100 and 200 are separable, they may be separated for maintenance on one or the other.

Alternatively, the first and second cabinets 100 and 200 may be integrally formed or formed as a single cabinet. In such a case, the single cabinet may be divided into first and second cabinets 100 and 200 by a dividing plate or partition wall, fully or partially separating the single cabinet into main and auxiliary spaces.

Next, in reference to the corresponding drawings, the cabinets 100 and 200 will be described in more detail.

A tub 105 that receives wash water and a drum (not shown) rotatable within the tub 105 may be mounted in a main or inner space 110 of the first cabinet 100. That is, the main space 110 may provide a place for washing laundry.

An opening (not shown) where a door 15 may be coupled may be formed at a front of the first cabinet 100 and a user may open the door 15 to load laundry into the drum via the opening. The drum may be rotatable within the tub 105. A driving mechanism 107 that drives the drum may be provided at a rear of the tub 105, and may be connected with a rotational shaft of the drum directly or through a belt to rotate the drum. Each of the first and second cabinets 100, 200 may include a control panel 100*b*, 200*b*.

The laundry treatment device of FIG. 2 may further include a heated-dry-air supply device 220 capable of supplying heated-dry-air to the drum. The heated-dry-air supply device 220 may be provided in the first cabinet 100 as mentioned above or it may be provided in an auxiliary space, separate from the first cabinet 100. If the heated-dry-air supply device 220 is provided in the first cabinet 100 together with the drum and the tub 105, the first cabinet 100 may be too small to install all of the necessary elements. In addition, if the capacity of the drum and the tub 105 is changed, all of the elements including the drum, the tub 105, and the heated-dry-air supply device 220, as well as the first cabinet 100, must be redesigned.

However, if the heated-dry-air supply device 220 is provided in an auxiliary or inner space of the second cabinet 200 and it is connected with a duct that supplies heated-dry-air to the drum and tub 105, only the elements of the drum and the tub 105 must be redesigned, even in the case of changing the capacity of the drum and the tub 105. That is, if an assembly including the heated-dry-air supply device 220 is provided, it may be possible to use the assembly corresponding to various capacities of the tub and the drum. Next, the second cabinet 200 including the heated-dry-air supply device 220 will be described.

Figure 3:
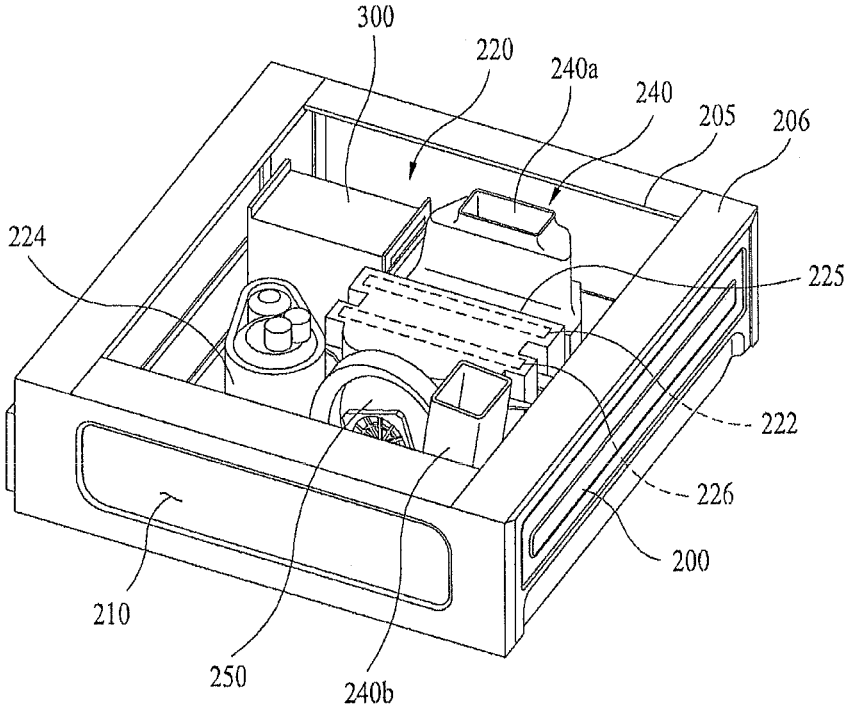
FIG. 3 is a rear perspective view of a second cabinet of the laundry treatment device of FIG. 1.

FIG. 3 is a rear perspective view of the second cabinet 200 of the laundry treatment device of FIG. 1. Referring to FIG. 3, with this embodiment the heated-dry-air supply device 220, which supplies heated-dry-air for the drum and the tub 105, may be provided in the second cabinet 200. Further, the second cabinet 200 may be separable from the first cabinet 100 as discussed above.

The heated-dry-air supply device 220 may be provided in an auxiliary or inner space 210 of the second cabinet 200. A volume of the second cabinet 200 may be substantially smaller than that of the first cabinet 100.

The first cabinet 100 may include an opening 105 in a lower wall 106 thereof. Further, the second cabinet 200 may include an opening 205 in an upper wall 206 thereof. Portions of the heated-dry-air supply device 200, which may be disposed in the second cabinet 200, may extend through the openings 105, 205 into the main or inner space 110 of the first cabinet 100.

If the laundry treatment device having the second cabinet 200 detachably provided according to an embodiment is delivered to a user's residence, the second cabinet 200 may be connected with the first cabinet 100 at the user's residence. Alternatively, it may be possible to change use of the second cabinet 200 before shipping the laundry treatment device. For example, the second cabinet 200 may be employed as a space for accommodating an air supply device, which will be described later, or as a storage space according to a user's selection. As a result, the second cabinet 200 may be utilized in various ways according the user's selection. It is also possible to ship a laundry treatment device having the second cabinet 200 connected with the first cabinet 100 in advance according to the user's selection.

As mentioned above, the second cabinet 200 may be separable from the first cabinet 100, which includes the drum and the tub 105. Because of this, it is possible to commodity the second cabinet corresponding to various capacities of the first cabinet 100. The second cabinet 200 may be separably connected with the first cabinet 100 by a fastening member, such as a bolt, although embodiments are not limited to this fastening structure.

The second cabinet 200 may be provided on, under, or next to the first cabinet 100. However, if the drum and the tub 105 are provided in the first cabinet 100, the user may load the laundry into the first cabinet 100. Unless the first cabinet 100 is high enough, the user may have to bend his/her waist to load the laundry, which is inconvenient. Thus, the second cabinet 200 may be provided under the first cabinet 100 such that the user may load the laundry into the first cabinet 100 without any difficulty or inconvenience.

In addition, the first and second cabinets 100 and 200 may be closed in an airtight manner to form inner spaces, respectively. Alternatively, they may be in communication, for example, via a connection portion.

As mentioned above, the heated-dry-air supply device 220 may be provided in the second cabinet 200, and thus, the first and second cabinets 100 and 200 may be opened partially (i.e. openings 105, 205) to communicate with each other to connect the heated-dry-air supply device 220 to a duct that connects the heated-dry-air supply device 220 with the tub 105. That is, a predetermined portion between the first and second cabinets 100 and 200 may be opened (i.e. openings 105, 205). For example, in the case that the second cabinet 200 is positioned under the first cabinet 100 as mentioned above, a predetermined portion of a bottom wall 106 of the first cabinet 100 and a predetermined portion of a top wall 206 of the second cabinet 200 may be open. If the predetermined portion of the second cabinet 200 is open, a predetermined portion of the heated-dry-air supply device 220 may be positioned in the main or inner space 110 of the first cabinet 100 via the open portion 205 of the second cabinet 200.

When the heated-dry-air supply device 220 provided in the second cabinet 200 needs checking and repair, the second cabinet 200 would need to be disassembled completely, which takes time and significant work. However, according to the laundry treatment device according to the embodiments disclosed herein, the auxiliary or inner space 210 of the second cabinet 200 may be accessible from outside of the laundry treatment device. More specifically, at least one of a front, rear and side of the second cabinet 200 may be configured of a detachable panel. For example, panel 20 of the laundry treatment device 10 of FIG. 1 may be detachable. Alternatively, a detachable drawer may be provided in the second cabinet 200 and the auxiliary or inner space 210 may be formed in the drawer. Such the drawer will be described in detail hereinafter.

The heated-dry-air supply device 220 according to embodiments heats air and supplies heated-dry-air to the drum and the tub 105, and it may be embodied in various forms or types. For example, the heated-dry-air supply device may be a heat pump. Alternatively, the heated-dry-air supply device 220 may be configured of any heater capable of heating air, for example, an electric type or a gas type.

Figure 4:
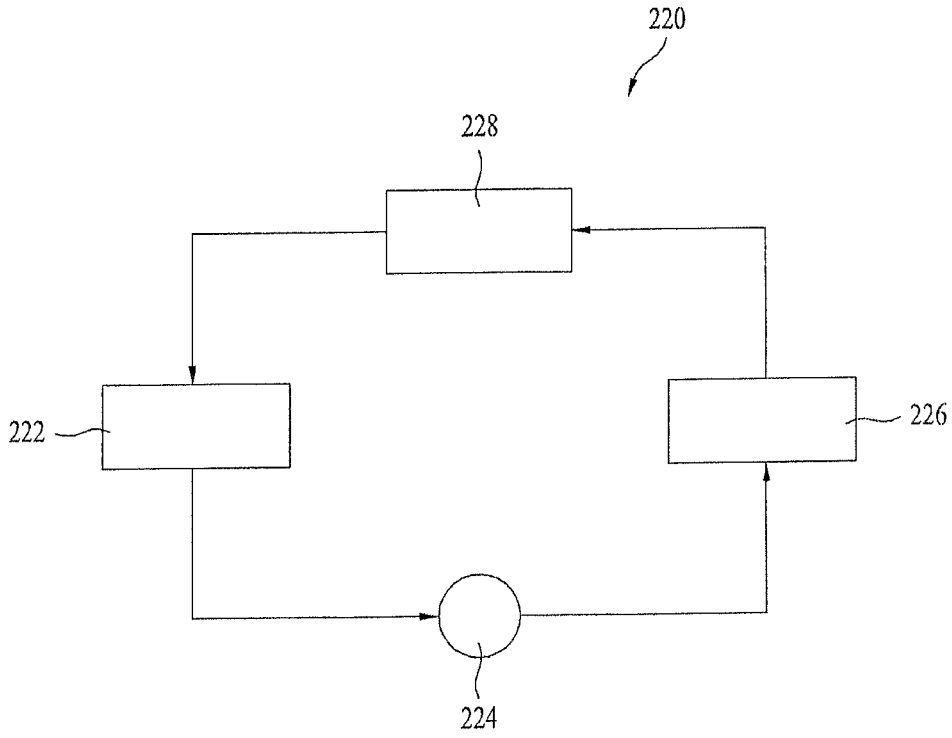
FIG. 4 is a schematic diagram of a heat pump according to an embodiment.

FIG. 4 is a schematic diagram of a heat pump according to an embodiment. Referring to FIG. 4, the heated-dry-air supply device 220, which may be a heat pump, may include an evaporator 222, a compressor 224, a condenser 226, and an expansion valve 228, which dehumidify and heat air.

More specifically, the evaporator 222 may evaporate refrigerant and absorb latent heat of ambient air. Hence, the air may be cooled and the moisture of the condensed air may be removed. When the refrigerant having passed through the compressor 224 is condensed at the condenser 226, latent air may be discharged toward ambient air and the air heated. As a result, the evaporator 222 and the condenser 226 may have heat exchanging functions. The heated-dry-air generated by the evaporator 222 and the condenser 226 may be supplied to the tub 105.

The temperature of the air heated by the heated-dry-air supply device 220 may be relatively lower than the temperature of the air heated by a conventional heater. However, the air heated by the heated-dry-air supply device 220 may be dehumidified without any auxiliary dehumidifying device. As a result, the air supplied to the tub 105 by the heated-dry-air supply device 220 may be relatively 'low temperature dried air'. Here, the term 'low temperature' does not mean a substantially low temperature, rather, the relatively low temperature air corresponds to the heated air having a relatively lower temperature than air heated by a conventional heater. The temperature of the air supplied by the heated-dry-air supply device 220 may be lower than the hot air heated by the conventional heater and the air supplied by the heated-dry-air supply device 220 may enable the dehumidified air to be supplied to the tub 105 without an auxiliary dehumidifying device.

The air dehumidified and heated by the heated-dry-air supply device 220 may be supplied to the tub 105 and the drum. More specifically, air discharged from the tub 105 may pass the evaporator 222 and the condenser 226 of the heated-dry-air supply device 220 along the circulation duct 240, only to be re-supplied to the tub 105. That is, the air discharged from the tub 105 may be dehumidified and heated by the heated-dry-air supply device 220, and may be re-supplied to the tub 105.

The circulation duct 240 may connect a rear portion of the tub 105 with a front of the tub 105, such that the air may be discharged via the rear portion and the air may be drawn in via the front portion. More specifically, the air may be discharged through an upper portion of the rear portion of the tub 105 and may be drawn in through an upper portion of the front portion of the tub, circulating therethrough.

The evaporator 222 and the condenser 226 of the heated-dry-air supply device 220 mentioned above may be employed as a heat exchanger. That is, the evaporator 222 and the condenser 226 may form a single heat exchanging assembly. As shown in FIG. 3, the evaporator 222 and the condenser 226 may be provided in a single housing 225 as a heat exchanging assembly. With such a construction, it is possible to install, check, and repair the heat exchanging assembly easily. Further, in a case that the evaporator 222 or the condenser 226 is abnormal, only the heat exchanging assembly need be exchanged without exchanging the device 220.

The circulation duct 240 may include an exhaustion duct 240*a* and a supply duct 240*b*. The exhaustion duct 240*a* may connect the upper portion of the rear portion of the tub 105 with the heat exchanging assembly 225 of the heat pump 220. The supply duct 240*b* may connect the upper portion of the front portion of the tub 105 with the heat exchanging assembly 225 of the heat pump 220.

More specifically, air drawn into the heat exchanging assembly 225 of the heated-dry-air supply device 220 via the exhaustion duct 240*a* may be dehumidified and heated so as to become heated-dry-air. The heated-dry-air may be re-supplied to the tub 105 via the supply duct 240*b* by operation of a fan 250. A filter 300 may be provided at the exhaustion duct 240*a*, through which the air of the tub 105 may be supplied to the heat exchanging assembly 225. The filter 300 may filter foreign matters, which may be contained in the air of the tub 105, and only fresh air re-supplied to the tub 105.

As mentioned above, the evaporator 222, the compressor 224, the condenser 226, and the expansion valve 228 of the heated-dry-air supply device 220 may be connected to each other by a refrigerant pipe, and thus, the air may be dehumidified and heated by the evaporation and condensation process of the refrigerant. The refrigerant may be discharged in the case of maintenance and repair of the heated-dry-air supply device 220, and it have to be re-filled after the maintenance and repair of the heated-dry-air supply device 220. To fill and discharge the refrigerant smoothly, the heated-dry-air supply device 220 applicable to the laundry machine according to an embodiment may include a refrigerant filler and a refrigerant discharge device, which will be described with reference to FIG. 5.

Figure 5:
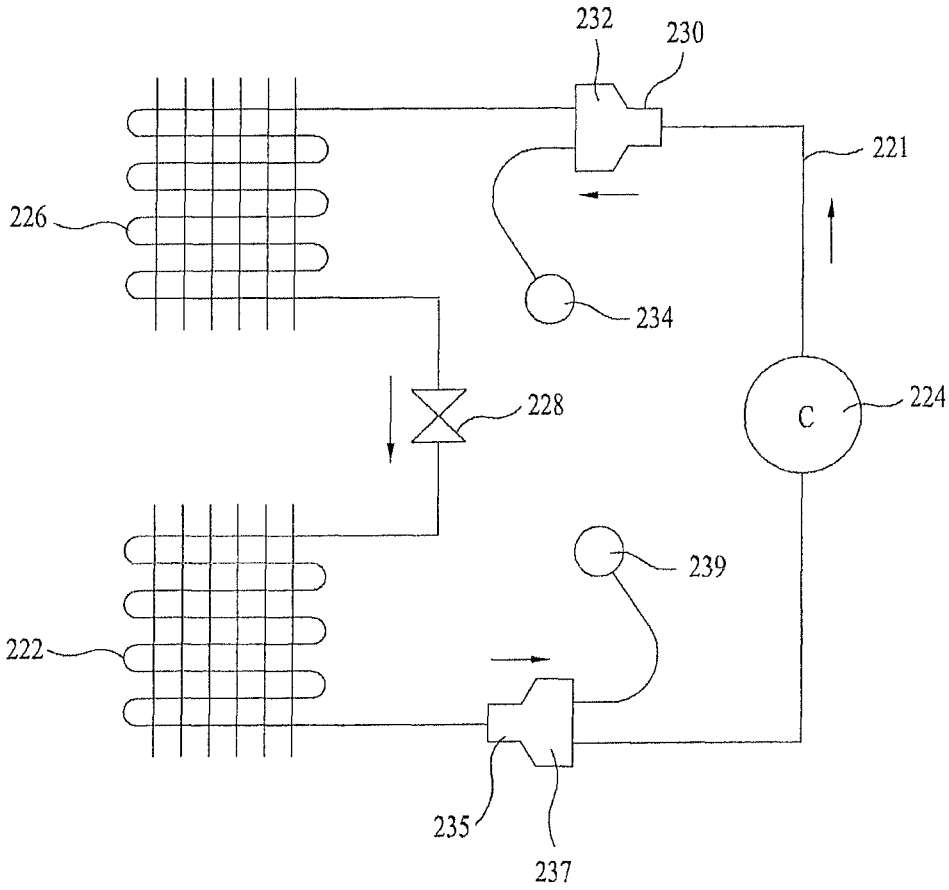
FIG. 5 is a schematic diagram of a refrigerant filler and refrigerant discharging device of a heat pump according to an embodiment.

FIG. 5 is a schematic diagram of a heat pump including a refrigerant filler and the refrigerant discharge device according to an embodiment. Referring to FIG. 5, the heated-dry-air supply device 220 may include the evaporator 222, the compressor 224, the condenser 226, and the expansion valve 228, which may be provided along a refrigerant pipe 221, and a refrigerant filler device 235 and a refrigerant discharge device 230.

The refrigerant filler 235 and refrigerant discharging device 230 may be embodied variously. For example, they may include binary branching pipes 237 and 232, and valves 239 and 234 branched from the binary branching pipes 237 and 232, respectively. Thus, a user may open the valve 239 of the refrigerant filler device 235 and supply refrigerant to the refrigerant pipe 221, or the user may open the valve 234 of the refrigerant discharge device 230 and discharge refrigerant from the refrigerant pipe 221. Thereafter, the user may close the valve 239 or 234 to prevent the refrigerant from leaking from the refrigerant pipe 221.

The refrigerant filler device 235 and the refrigerant discharge device 230 may be provided along the refrigerant pipe 221. The refrigerant filler device 235 may be provided along a portion of the refrigerant pipe 221 that connects the evaporator 222 and the compressor 224, and the refrigerant discharge device 230 may be provided along a portion of the refrigerant pipe 221 that connects the compressor 224 and the condenser 226.

The pressure of the refrigerant inside a front end of the compressor 224 with respect to the compressor 224, that is, along the portion of the refrigerant pipe 221 that connects the compressor 224 and the evaporator 222 is relatively low and the pressure of the refrigerant inside a rear end of the compressor 224, that is, along the portion of the refrigerant pipe 221 that connects the compressor 224 and the condenser 226 is relatively high. As the pressure of the refrigerant inside the refrigerant pipe 221 increases, it gets easier to discharge the refrigerant. Because of this, the discharge device 230 may be provided along the portion of the refrigerant pipe 221 that connects the compressor 224 and the condenser 226. As the pressure of the refrigerant inside the refrigerant pipe 221 decreases, it becomes easier to fill the refrigerant. Because of this, the refrigerant filler device 235 may be provided along the refrigerant pipe 221 that connects the compressor 224 and the evaporator 222.

Figure 6A:
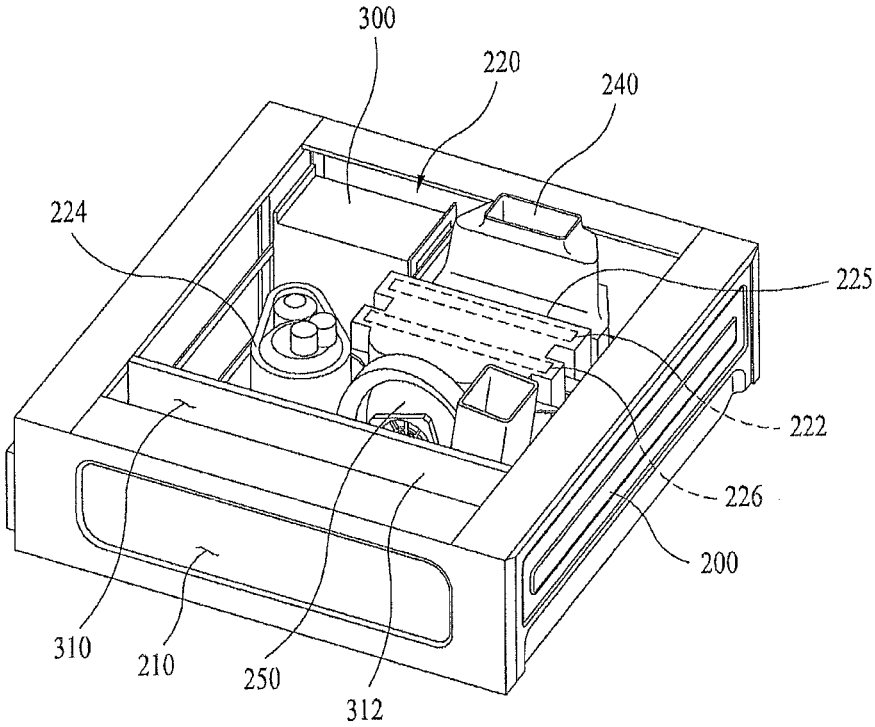
FIG. 6A is a rear perspective view of a second cabinet according to another embodiment.

FIG. 6A is a rear perspective view of a second cabinet according to another embodiment. When a user uses the laundry treatment device, it may be necessary to keep various accessories, such as detergent, in the laundry treatment device. However, keeping such accessories at an upper portion of the laundry treatment device may deteriorate an external aesthetic appearance of the laundry treatment device. In addition, detergent may dissolve in wash water and leak into a display part and/or a selection part of the laundry treatment device, which may cause operational failure of the laundry treatment device. As a result, a predetermined space may be provided for keeping such various kinds of accessories in the laundry treatment device. According to this embodiment, the second cabinet 200 may be provided in the laundry treatment device and the second cabinet 200 may include a predetermined space for keeping accessories.

Referring to FIG. 6A, the heated-dry-air supply device 220 is positioned in a predetermined portion of the second cabinet 200, that is, in the auxiliary or inner space 210 of the second cabinet 200. A third space 310 may be provided at an opposite portion of the inner space 210 inside the second cabinet 200. At least one of the front, rear, and side of the second cabinet 200 may be configured as a detachable panel as mentioned above. In such a case, the third space 310 may be provided along the detachable panel, so that a user may have access to the third space 310 through the detachable panel. Further, the third space 310 may be partitioned off from the second space 210 by a partition wall 312.

Figure 6B:
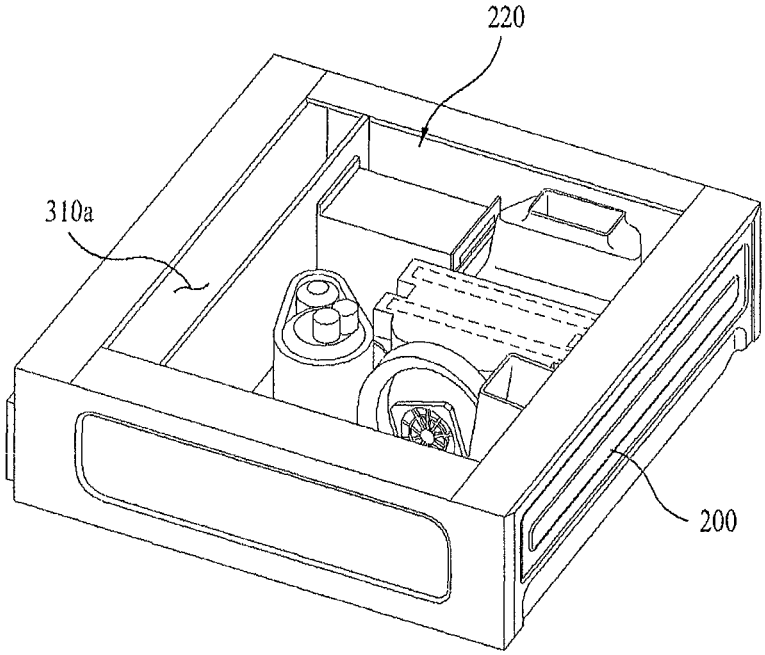
FIG. 6B is a rear perspective view of a second cabinet according to another embodiment.

If the detachable panel is provided along one side of the second cabinet 200, the heated-dry-air supply device 220 may be arranged along another side of the second cabinet 200 and the third space may be provided along the side of the second cabinet 200 adjacent the detachable panel. Alternatively, if the detachable panel is provided at a front of the second cabinet 200, the heated-dry-air supply device 220 may be arranged along a rear of the second cabinet 220 and the third space 310 may be provided along the front of the second cabinet 200, as shown in FIG. 6B. Additionally, the second cabinet 220 of this embodiment may be in the form of a drawer.

Figure 7:
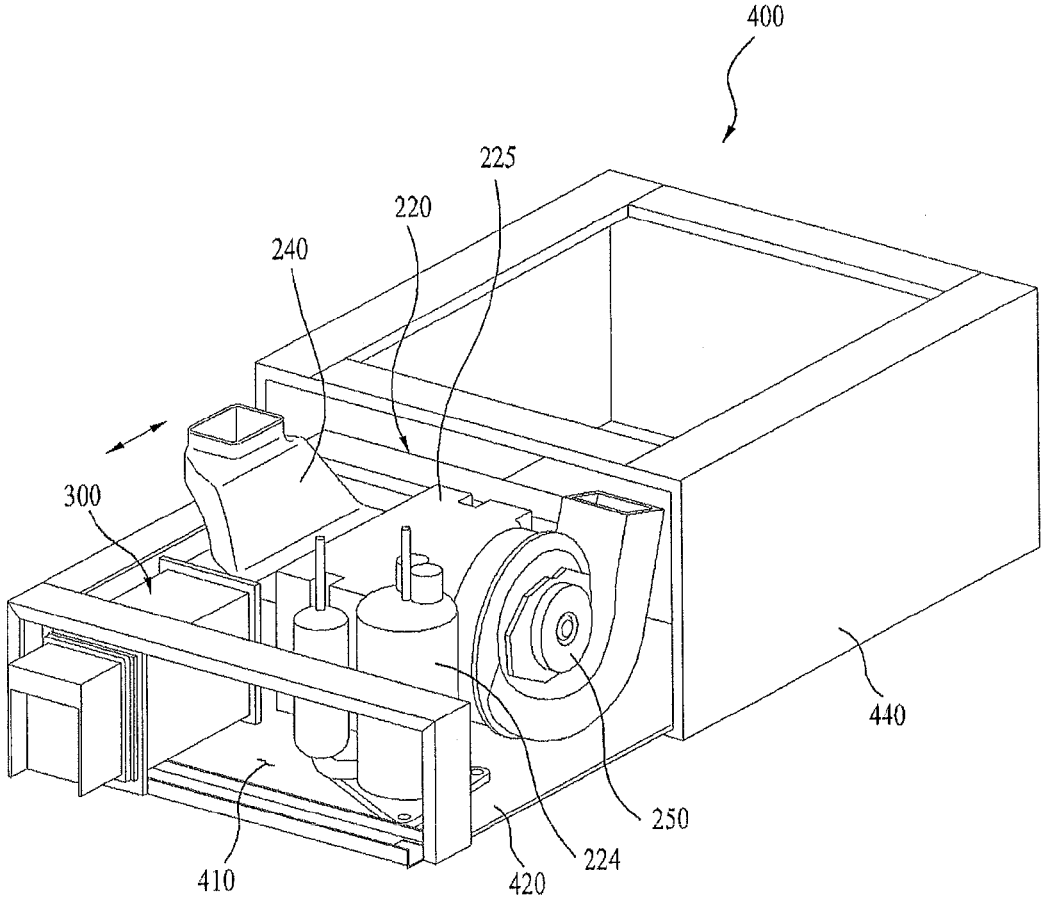
FIG. 7 is a front perspective view of a second cabinet including a drawer according to an embodiment.

FIG. 7 is a front perspective view of a second cabinet provided in a laundry machine according to another embodiment. The second cabinet 400 of FIG. 7 may include a drawer 420.

Referring to FIG. 7, the second cabinet 400 may include a drawer 420 forming a second space 410 and a frame 440 to which the drawer 420 is detachably and slidingly connected. The drawer 420 may be detachable from the second cabinet 400 via one of a front, rear, and side of the second cabinet 400. For the user's convenience, the drawer 420 may be detachable via the front of the second cabinet.

As shown in FIG. 7, the second space 410 may be formed in the drawer 420 detachably provided in the second cabinet 400, and the heated-dry-air supply device 220 may be mounted in the second space 410. With such a structure, the first cabinet 100 or second cabinet 200 does not have to be disassembled and only the drawer 420 detached in the case of maintenance of the heated-dry-air supply device 220.

If the drawer 420 is detached from the second cabinet 400 in the above case, it may be required to prevent damage to the connection portion between the circulation duct 240 and the heat pump 220. Such protection for the connection portion may be embodied variously. For example, although not shown in the drawings, the connection portion between the circulation duct 240 and the heat pump 220 may be configured of a flexible tube which may be extendable and retractable. If the drawer 420 is detached and pulled, the connection portion may extend from the drawer 420 to be slidingly drawn out from the second cabinet 400 smoothly. If the drawer 420 is pushed, the connection portion may be retracted as the drawer 420 is re-inserted.

The configuration of the third space 310 provided in the drawer 420, separate from the second space 210, may be similar to the configuration of the third space according to the above embodiment, and thus, repetitive disclosure has been omitted.

Figure 8:
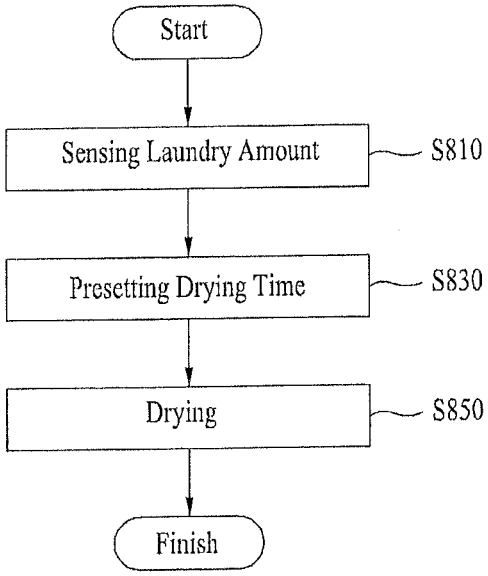
FIG. 8 is a flow chart of a control method according to an embodiment.

Next, a control method for a laundry treatment device having the above described configuration will be described hereinafter. FIG. 8 is a flow chart of a control method according to an embodiment.

Referring to FIG. 8, the control method according to this embodiment includes a laundry amount sensing step, step S810, in which an amount of laundry is sensed, a drying time setting step, step S830, in which at least one drying time according to the laundry amount is set, and a drying step, step S850, in which drying of the laundry by using dry hot air is performed. According to this embodiment, operation of the laundry machine is controlled by sensing dryness of the laundry. A drying time is preset according to the sensed laundry amount and the drying step is performed according to the preset drying time.

Figure 9:
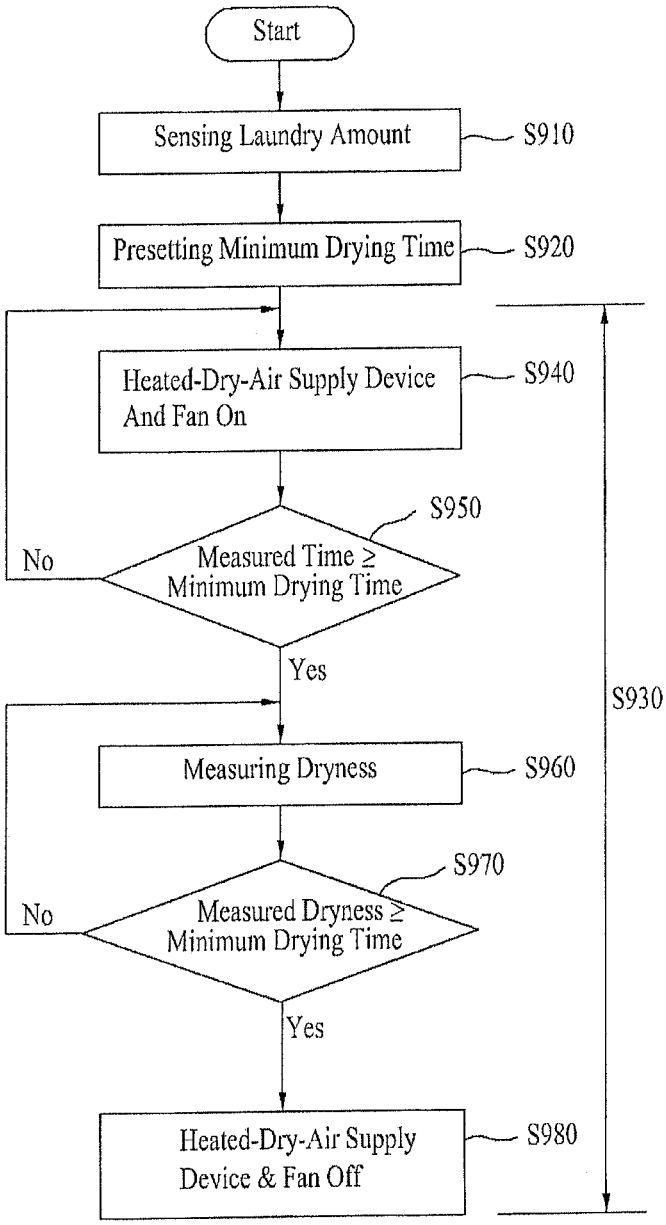
FIG. 9 is a flow chart of a control method according to another embodiment.

FIG. 9 is a flow chart of a control method according to another embodiment. Referring to FIG. 9, according to this embodiment, the amount of laundry to be washed is first sensed, in step S910. There are many ways to sense the laundry amount. For example, the drum operated and the laundry amount may be sensed based on a time for the rotation of the drum to reach a predetermined number of rotations, or by using a sensor. A minimum drying time may be preset according to the sensed laundry amount, in step S920.

According to this control method, dryness of the laundry may be sensed and the heated-dry-air supply device 220 of the laundry treatment device controlled to be turned on and off. More specifically, if the sensed dryness is over a predetermined reference dryness, it may be determined that the drying is completed, such that the heated-dry-air supply device 220 is turned off.

If the dryness is sensed simultaneously with the supply of the heated dry air, a dryness sensor may fail to sense dryness precisely. More particularly, if the dryness of the laundry is determined based on sensed air dryness, a lot of moisture may not have evaporated, and thus, the dryness of air may be sensed relatively high. As a result, the drying step may be finished in a state in which the drying is not completed. To solve this problem, in this embodiment, the minimum drying time may be preset according to the sensed laundry amount, such that the heated dry air may be supplied for at least the minimum drying time without sensing the dryness of the laundry.

The minimum drying time may be preset appropriately corresponding to the laundry amount. For example, minimum drying times corresponding to various amounts of laundry, respectively, may be preset and input to a controller (not shown). Hence, the minimum drying time corresponding to the sensed laundry amount may be read and set. Hence, the drying step, step S930, in which dry hot air is supplied may start.

During the drying step, the heated-dry-air supply device 220 and the fan 250 may be powered on and the heated dry air supplied to the tub 105, such that the laundry may be dried by the heated dry air. Further, a time for the heated-dry-air supply device 220 and the fan 250 to operate may be measured.

Then, the controller may compare the measured operation time with the minimum drying time, in step S950. That is, if the measured time is below the minimum drying time, the heated-dry-air supply device 220 and the fan 250 may be operating continuously and the heated dry air may be supplied continuously. This may be performed to supply the heated dry air during the minimum drying time without sensing the dryness. If the measured time is over the minimum drying time, it means that the heated dry air is supplied during the minimum drying time, and thus, it may be determined whether to power off the heated-dry-air supply device 220 and the fan 250.

More specifically, after the dryness is sensed, in step S960, the measured dryness may be compared with a predetermined reference dryness, in step S970. The reference dryness may be adjusted appropriately. For example, when manufacturing the laundry machine, the reference dryness may be preset in the controller or after installing the laundry machine, a control panel (not shown) may be provided to allow the user to adjust the reference dryness according to his or her selection.

Although not shown in the drawings, the controller of the laundry machine may include a display step, in which the sensed dryness may be displayed to the user in the case of sensing the dryness. If a display is provided at a predetermined portion of the laundry machine, the display step may be possible. For example, the display may be provided in the control panel as mentioned above.

If the sensed dryness is below the reference dryness, it may be determined that the drying of the laundry is not complete, such that the heated dry air is continuously supplied and the dryness may be sensed continuously. If the sensed dryness is over the reference dryness, it may be determined that the drying of the laundry is complete, such that the heated-dry-air supply device 220 and the fan 250 may be powered off to finish the drying step. In the case that the drying step finishes, the controller may inform the user of the finishing of the drying step through the display.

However, according to this embodiment, if the minimum drying time passes, it may be determined based on the sensed dryness whether to power off the heated-dry-air supply device 220 and the fan 250. If the sensed dryness is not over the reference dryness because the dryness sensor malfunctions or the dryness sensor fails to sense dryness precisely, the drying step may not be finished but operated continuously. To prevent such a problem, a control method according to another embodiment will be described hereinbelow.

Figure 10:
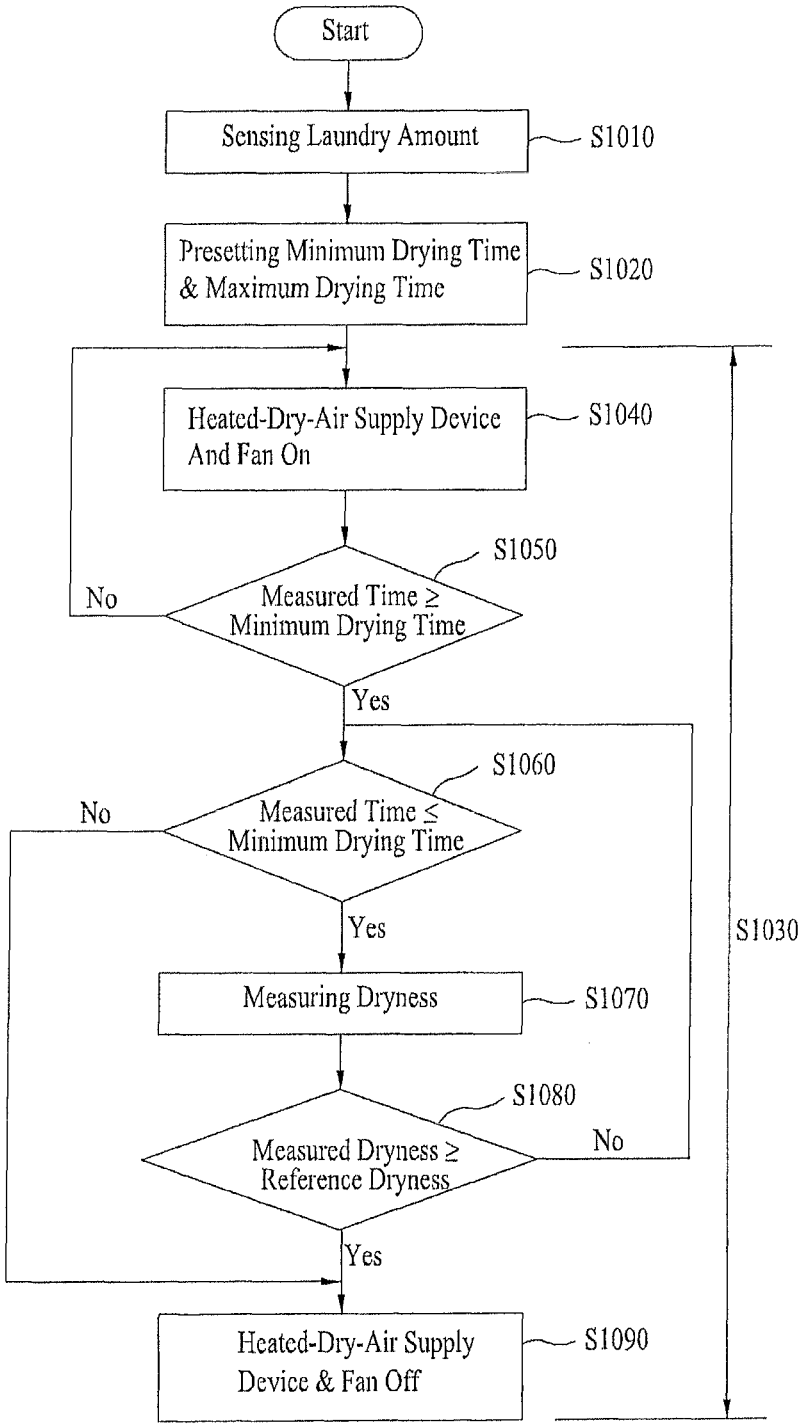
FIG. 10 is a flow chart of a control method according to a still further embodiment.

FIG. 10 is a flow chart of a control method of a laundry treatment device according to another embodiment. Compared with the above described embodiment, this embodiment of FIG. 10 has a different feature in that the heated dry air is supplied according to a maximum drying time together with the minimum drying time.

Referring to FIG. 10, according to the control method of this embodiment, the laundry amount may be sensed, in step S1010, and then, the minimum drying time and the maximum drying time may be preset according to the sensed laundry amount, in step S1020. The maximum drying time may be preset to prevent the drying step of supplying the heated dry air from continuing endlessly. As mentioned above, if the sensed dryness is not over the reference dryness because of malfunction of the dryness sensor, the drying step may continue forever and this results in waste of energy and user's dissatisfaction. As a result, according to this embodiment, if the sensed dryness is over the reference dryness or the measured time passes the maximum drying time, that is, either of the two conditions is satisfied, the drying step may be finished.

The maximum drying time may be preset appropriately, corresponding to the laundry amount. For example, maximum drying times may be preset corresponding to various laundry amounts, respectively, and input to the controller. Then, the maximum drying time corresponding to the sensed laundry amount may be read and set.

The step S1050 of comparing the time for the heated-dry-air supply device 220 and the fan 250 to operate with the minimum drying time after powering on the heated-dry-air supply device 220 and the fan 250 is identical to the step of the above embodiment and repetitive disclosure thereof has been omitted.

The controller may compare the measured time with the preset maximum drying time, in step S1060. If the measured time is below the maximum drying time, dryness may be sensed by the dryness sensor, in step S1070, and the measured dryness may be compared with the reference dryness, in step S1080.

If the measured dryness is over the reference dryness, it may be determined that the drying of the laundry is complete. Both the heated-dry-air supply device 220 and the fan 250 may be off, and the drying step may be finished. If the measured dryness is below the reference dryness, it may be determined that the drying is not completed. The step of comparing the measured time with the maximum drying time may then be repeated.

The laundry treatment device according to embodiments disclosed herein is capable of performing washing efficiently with maintenance works thereof performed conveniently.

That is, as mentioned above, the laundry machine or laundry treatment device according to embodiments disclosed herein may include the heated-dry-air supply device, which may be a heat pump, to supply heated dry air to the laundry, and thus, it may wash the laundry more efficiently.

Further, the heated-dry-air supply device, which may be a heat pump, may be provided in the space accessible from the outside, and thus, maintenance work for the heated-dry-air supply device may be performed easily and smoothly.

Embodiments disclosed herein may provide a laundry treatment device capable of performing washing more efficiently. Further, embodiments disclosed herein may provide a laundry treatment device including an accessible space for smooth and convenient maintenance work.

That is, embodiments disclosed herein provide a laundry machine or laundry treatment device that includes a first space for laundry treatment; a second space distinguishable from the first space; and an air supply device provided in the second space, the air supply device supplying dry hot air to the first space.

Further, embodiments disclosed herein provide a laundry machine or laundry treatment device that includes a first space for washing laundry; and a second space separably connected with the first space, the second space selectively useable.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment device, comprising:

a first cabinet configured for laundry treatment therein;

a tub provided in the first cabinet;

a second cabinet formed integrally with the first cabinet, the second cabinet provided under the first cabinet;

a heated-dry-air supply device comprising a heat pump including an evaporator, a compressor, a condenser, and an expansion valve, the heated-dry-air supply device provided in the second cabinet and supplying heated dry air to the first cabinet; and a circulation duct connecting the heated-dry-air supply device with the tub, wherein the second cabinet further comprises a drawer in which the heated-dry-air supply device is provided, wherein the first and second cabinets are opened partially and communicates with each other to connect the heated-dry-air supply device to the circulation duct, and wherein a connection portion between the circulation duct and the heat pump is a flexible tube which is extendable and extractible when the drawer is pulled out from the second cabinet.

2. The laundry treatment device of claim 1, wherein an inner space of the second cabinet is accessible from outside of the laundry machine.

3. The laundry treatment device of claim 2, wherein at least one of a front surface, a rear surface, a first side surface, or a second side surface of the second cabinet comprises a detachable panel.

4. The laundry treatment device of claim 1, wherein the air supply device is provided in a first inner space of the drawer.

5. The laundry treatment device of claim 4, wherein the drawer further comprising a second inner space separated from the first inner space.

6. The laundry treatment device of claim 1, wherein the circulation duct comprises an exhaust duct that connects the heat pump and an upper portion of a rear end of the tub and a supply duct that connects the heat pump and an upper portion of a front end of the tub.

7. The laundry treatment device of claim 6, further comprising:

a dryness sensor that senses dryness of air flowing along the circulation duct.

8. The laundry treatment device of claim 7, wherein the dryness sensor senses dryness of air discharged from the tub before the air is drawn into the heat pump.

9. The laundry treatment device of claim 1, wherein the heat pump further comprises a filler that fills refrigerant into the heat pump and a discharge device that discharges refrigerant form the heat pump.

10. The laundry treatment device of claim 9, wherein the filler is provided at a refrigerant pipe that connects the evaporator and the compressor and the discharge device is provided at a refrigerant pipe that connects the compressor and the condenser.

11. The laundry treatment device of claim 10, wherein the filler and the discharge device comprise binary branching pipes, and valves branched from the binary branching pipes, respectively.

12. The laundry treatment device of claim 1, wherein the second cabinet has an opening formed in an upper wall thereof through which the air supply device extends into an inner space of the first cabinet.

13. The laundry treatment device of claim 1, further comprising:

a drum rotatable provided in the tub.

* * * * *